United States Patent [19]

Smallegan

[11] 4,265,030

[45] May 5, 1981

[54] ARTICLE DRYER

[75] Inventor: Jon M. Smallegan, Farmington Hills, Mich.

[73] Assignee: Novo Products, Inc., Farmington Hills, Mich.

[21] Appl. No.: 55,344

[22] Filed: Jul. 6, 1979

[51] Int. Cl.[3] ..... F26B 19/00

[52] U.S. Cl. ..... 34/104; 34/239; 415/219 R

[58] Field of Search ..... 34/103, 104, 202, 231, 34/232, 239, 243 R; 415/207, 219 R; 219/367, 368

[56] References Cited

U.S. PATENT DOCUMENTS

| | | | |
|---|---|---|---|
| 2,420,401 | 5/1947 | Prokofieff | 415/207 |
| 2,443,695 | 6/1948 | Russell | 34/104 |
| 3,203,112 | 8/1965 | Edmonds | 34/104 |
| 3,513,564 | 5/1970 | Gramprie | 34/104 |

FOREIGN PATENT DOCUMENTS

| | | | |
|---|---|---|---|
| 456089 | 4/1949 | Canada | 415/207 |

*Primary Examiner*—Albert J. Makay
*Assistant Examiner*—Harold Joyce
*Attorney, Agent, or Firm*—Harness, Dickey & Pierce

[57] ABSTRACT

An apparatus for drying articles of apparel having a centrifugal blower associated with a housing for providing a flow of air through several tubes extending from the housing. The articles are disposed at the output portion of the tubes for drying the wet articles from the inside out. The improvement in the drying apparatus is a pocket formed at the inlet of each of the tubes. These pockets are formed, at least in part, by a wall portion which diverges relative to the flow of air from the blower. This wall continues to form a wall portion which is generally disposed transversely to the flow of air. These pockets capture a portion of the flow of air from the blower and direct the air flow into each of the tubes.

3 Claims, 5 Drawing Figures

ARTICLE DRYER

BACKGROUND OF THE INVENTION

The present invention provides an apparatus for air flow drying of articles of apparel and the like. One known dryer is comprised of two tubes connected to a blower and motor, which is located at the base of the dryer. Wet articles of apparel, such as shoes or boots, are placed over the free ends of the tubes. Air is forced through the tubes by the blower, which causes the articles to be ventilated with air. This assists in the drying of the wet articles from the inside out.

The inherent short coming of the above drying apparatus is that a partial blockage of one tube by an article of apparel placed over the other tube dramatically reduces the air flow through that tube in favor of the unblocked tube. Consequently, the tube that is performing the useful function, i.e., the tube on which the apparel is placed, has its air flow substantially reduced relative to the unblocked tube. This result is counter to the purposes of the device.

SUMMARY OF THE INVENTION

The present invention provides a novel drying apparatus using a source of air communicating with a plurality of tubes for drying one or more articles, and which includes a novel provision for reducing the effects of the partial blockage of one of the tubes by an article placed over another tube. Particularly, the drying apparatus of the present invention features a housing having a pocket formed at the inlet of each tube. Each pocket is defined, at least in part, by a diverging wall portion and an obstructing wall portion. These pockets are believed to operate as follows: As the flow of air from the blower enters a pocket, the diverging wall defines a divergent flow section which provides a pressure recovery to thereby increase the pressure at the inlet of the tube. The obstructing wall interrupts a portion of the flow of air and directs it into the tube. Consequently, these pockets provide a degree of air flow isolation between the inlets of the tubes and cause the air pressure at each inlet and the air flow into the tubes to be somewhat independent of the conditions at the other tubes.

Other features and advantages of the present invention will become apparent from the subsequent description of the preferred embodiment and the appended claims (taken in conjunction with the accompanying drawings.)

DETAILED DESCRIPTION OF THE PREFERRED EMBODIMENT

Figure 1:
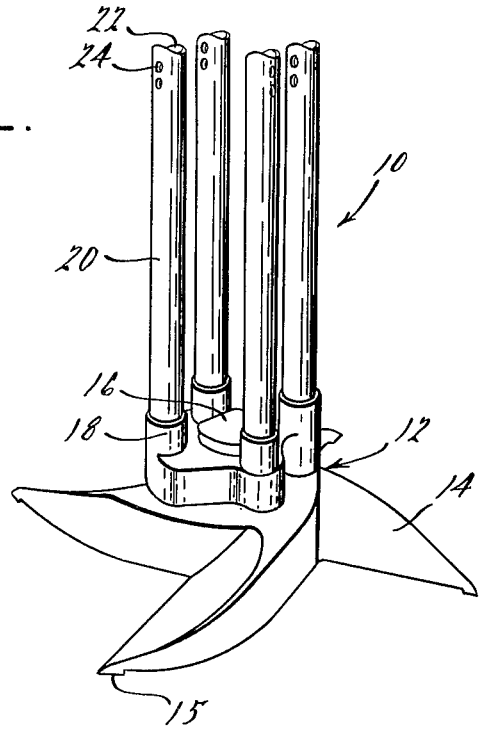
FIG. 1 is a prospective view of the article dryer embodying the present invention.
Figure 3:
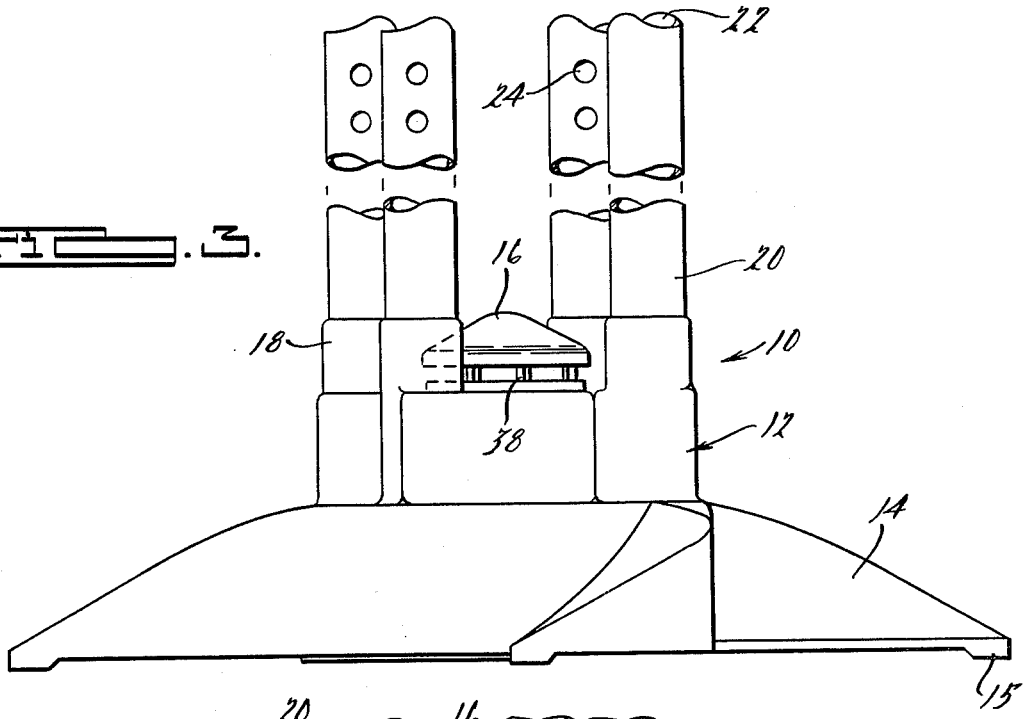
FIG. 3 is a side view of the article dryer illustrating the secondary outlets at the ends of the tubes and the safety cap over the inlet to the blower.

Referring to FIG. 1, an article dryer 10 embodying the present invention is shown. The article dryer has the capacity for drying several wet articles of apparel and the like simultaneously. Articles such as boots or shoes are disposed on the free ends of the tubes 20 extending from the housing 12. Each free end is defined by a primary outlet 22 and a plurality of secondary outlets 24. The secondary outlets 24 are best illustrated in FIG. 3, and have a diameter of 0.25 inches. The base of the housing is formed from four pinwheel flanges 14, which provide support for the article dryer 10. An edge 15 is provided at the tip of the pinwheel flanges 14 for added stability.

Figure 4:
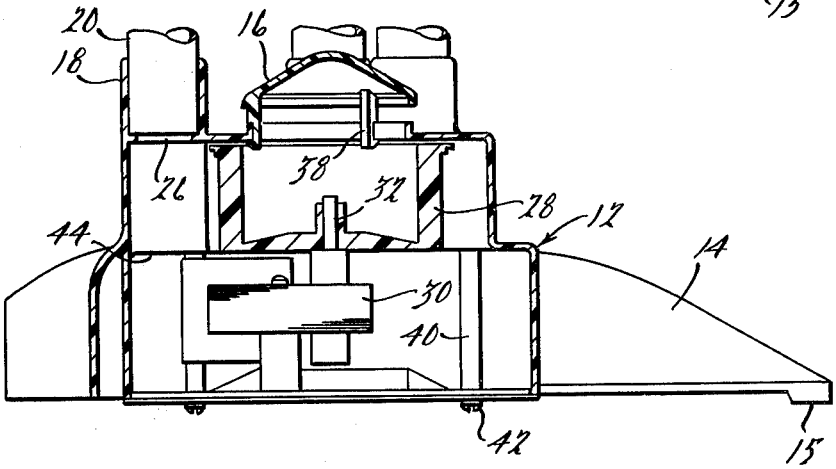
FIG. 4 is a cross-sectional view of the article dryer shown in Fig. 3.

Referring to FIG. 4, the tubes 20 are shown to engage in the tube sleeves 18 of the housing 12. It should be clear that this engagement may be accomplished by a variety of ways well known to those skilled in the art. It is equally true that these tubes 20 may be formed integral to the housing 12. However, by providing tubes which are disengagable from the housing, the drying apparatus may be more easily stored when not in use. In the preferred embodiment, the housing 12 and tubes 20 are made from high-impact plastic. The tubes 20 have a thickness of approximately 0.0625 inches, and have an outer diameter of approximately one inch.

The air enters the housing from the gap between the safety cap 16 and the housing 12. The safety cap 16 aids in preventing physical objects from coming into contact with the blade of the blower 28. The safety cap 16 is supported by several members 38 connected to the housing 12 at one end and the safety cap 16 at the other. The air enters the squirrel cage blower 28 as it revolves around its axis defined by a rotor 32 extending from a motor 30. The electrical motor 30 is a Barber-Coleman type AD, and consumes 25 watts at 110 volts during normal operation. The motor 30 is attached to the housing 12 by a plurality of motor mounting members 40 which employ screws 42 to engage the housing 12.

Figure 5:
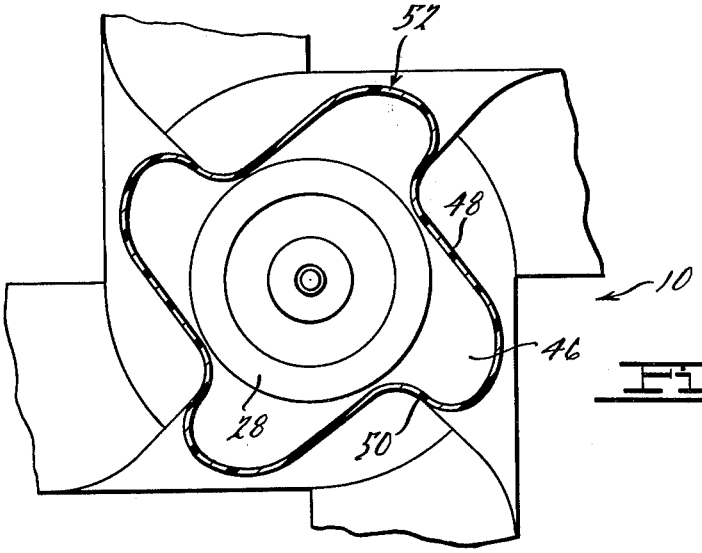
FIG. 5 is a top cross-sectional view of the pockets with respect to the centrifugal blower.

The air flow from the blower 28 is captured in the four pockets 46 and directed to the inlet of each tube 26. The pockets 46 are best illustrated in FIG. 5. These pockets are formed, at least in part, by the continuous side wall 52 of the housing 12. The flow of air from the blower enters the pocket at the diverging portion of the wall 48 which extends generally in the tangential direction with respect to the pre-determined axis 32 of the blower 28. The wall portion 48 also diverges relative to the flow of air from the blower 28. This air flow is then interrupted at an obstructing wall portion 50 which extends generally in the radial direction with respect to the pre-determined axis 32 of the blower 28. The wall portion 50 also is generally disposed transversely to the flow of air from the blower 28. These pockets are further defined by a partition 44, which is best illustrated in FIG. 4. This partition is also used to separate the centrifugal blower from the electric motor in order to minimize the transfer of moisture to said electric motor.

Figure 2:
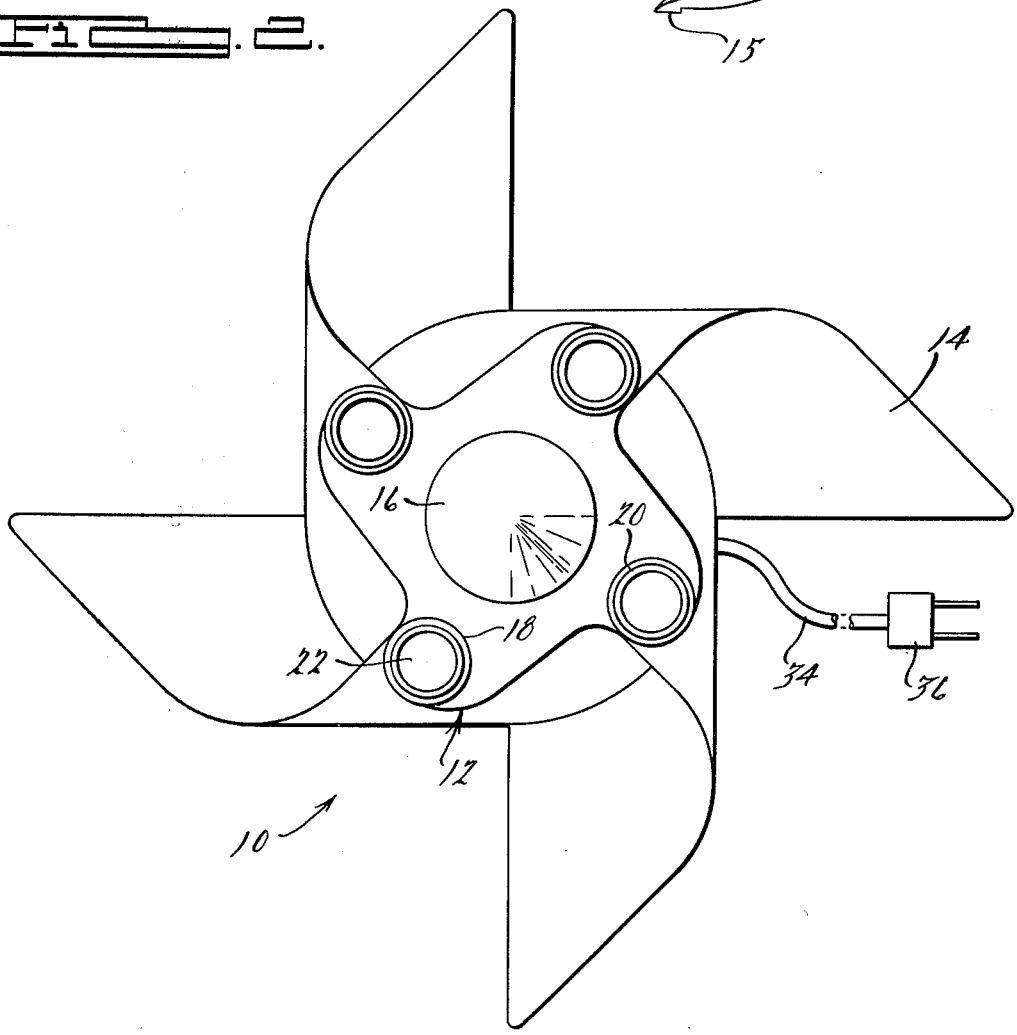
FIG. 2 is a top view illustrating the position of the inlet of the tubes relative to the pockets formed by the walls of the housing.

FIG. 2 illustrates the position of the tubes 20 relative to the pockets 46. It is believed that the pockets 46, and in particular the diverging wall portion 48, increase the pressure of the air at the inlets of the tubes 26. This pressure recovery reduces the effect of the partial blockage of one of the tubes by an article placed over another tube. These pockets 46 also provide a degree of air flow isolaton between the inlet of the tubes, and cause the air pressure at the inlet and the air flow into the tubes to be somewhat independent of the conditions at the other tubes.

FIG. 2 also illustrates the electric cord 34 from the motor 30 and the conventional plug 36. In order to operate the article dryer, the plug 36 is merely inserted into a conventional electrical socket and the motor will immediately cause the blower 28 to rotate. This in turn creates a flow of air through the tubes 20 to ventilate the articles disposed at the free ends of the tubes. As the articles will be dried at room temperature, there is no need for a timer to automatically turn off the source of air through the tubes. However, if a heater is employed relative to the housing 12 to provide above ambient temperature drying, a timer or a switch may be added to the motor 30.

It will be appreciated by those skilled in the art that the preferred embodiment of the invention disclosed herein is susceptible to modification, variation and change without departing from the proper scope or fair meaning of the sub-joined claims.

What I claim:

1. For an article dryer:

a housing;

a plurality of tubes extending from said housing, each tube having an inlet and an outlet portion on which said article is to be disposed for drying;

a blower means, associated with said housing, for providing a flow of air through said tubes in order to ventilate said article, the improvement comprising: pocket means, formed in said housing for each of said plurality of tubes, having a wall portion which diverges relative to said flow of air from said blower means and a wall portion which is disposed generally transversely of said flow of air, for capturing a portion of said flow of air and for directing said portion of said flow of air into said inlet of each of said tubes, so that the effect upon air flow through one of said tubes, due to a restriction of said outlet thereof by said articles, is reduced when less than all of said outlets of said tubes are likewise restricted.

2. An article dryer according to claim 1 wherein said blower means includes rotary fan means for rotating about a pre-determined axis and wherein said transversely disposed wall portion extends generally in the radial direction with respect to said pre-determined axis.

3. An article dryer according to claim 1 wherein said blower means includes rotary fan means for rotating about a pre-determined axis and wherein said diverging wall portion extends generally in the tangential direction with respect to said pre-determined axis.

* * * * *